United States Patent [19]

Lassen

[11] Patent Number: 4,608,292

[45] Date of Patent: Aug. 26, 1986

[54] WEB WITH ENHANCED FLUID TRANSFER PROPERTIES AND METHOD OF MAKING SAME

[75] Inventor: Frederich O. Lassen, Winnebago County, Wis.

[73] Assignee: Kimberly-Clark Corporation, Neenah, Wis.

[21] Appl. No.: 542,332

[22] Filed: Oct. 17, 1983

[51] Int. Cl.[4] ..... B32B 3/10

[52] U.S. Cl. ..... 428/131; 428/155; 428/283; 428/288

[58] Field of Search ..... 428/131, 155, 283, 288

[56] References Cited

U.S. PATENT DOCUMENTS

| | | | |
|---|---|---|---|
| 3,293,104 | 12/1966 | Hull | 428/155 |
| 3,978,257 | 8/1976 | Ring | 428/137 |
| 4,014,341 | 3/1977 | Karami | 428/131 |
| 4,200,558 | 4/1980 | Holst et al. | 524/43 |
| 4,276,338 | 6/1981 | Ludwa et al. | 428/137 |
| 4,355,066 | 10/1982 | Newman | 428/138 |

*Primary Examiner*—Joseph L. Schofer
*Assistant Examiner*—Bernard Lipman
*Attorney, Agent, or Firm*—Paul A. Leipold; Donald L. Traut; J. J. Duggan

[57] ABSTRACT

An absorbent web is provided with spaced apertures which have been formed by slitting, tensioning, and setting fusible material which forms a part of the web. The web preferably includes absorbent material which is capable of increased absorbency when compared to conventional cellulosic fibers.

4 Claims, 3 Drawing Figures

WEB WITH ENHANCED FLUID TRANSFER PROPERTIES AND METHOD OF MAKING SAME

FIELD OF THE INVENTION

This invention relates to an absorbent web and particularly to one which can be used for diapers, sanitary napkins and the like.

BACKGROUND OF THE INVENTION

Webs or batts containing absorbent fibers have been used for a number of years in products such as diapers, sanitary napkins and the like. These webs are conventionally made of cellulose fibers and provide a relatively inexpensive absorbent matrix. Webs of cellulosic fibers however do have some disadvantages. As these webs become wet, they contract and the capillaries which provide the basis for absorption tend to collapse. As a result of this contraction, the web becomes stiff and the potential absorbent capacity present is not utilized. Attempts have been made recently to provide a batt or web of mixed fibers, i.e., one containing thermoplastic fibers. These fibers, while not absorbent in themselves, remain resilient when exposed to aqueous based fluids. Also, they have the effect of spacing the individual cellulosic fibers and, as a result, tend to inhibit the collapse of individual capillaries due to the wetting of the web. An example of such a web is disclosed in U.S. Pat. No. 4,100,324 issued to Anderson and Sokolowski.

Recently there have been a class of absorbent compounds introduced which, while not as inexpensive as cellulose can, under ideal conditions, absorb a substantially greater amount of fluid than cellulose. These materials which are available in both powder and fibrous form, have much smaller capillaries than cellulose as a rule. This class of material is particularly susceptible to early failure as an absorbent when the absorbing fluid is viscous and/or contains suspended particles. When these improved absorbents are used for the uptake of menses or blood, they fail to absorb at a capacity anywhere near their capacity for less viscous fluids. (These materials, e.g. phosphorylated pulp, carboxymethylcellulose, modified rayon, etc. are those generally referred to throughout the specification as those which are more highly absorbent with an equal volume of cellulose fibers under ideal conditions of an aqueous based essentially nonviscous fluid.)

The problem of premature failure as an absorbent of these increased absorbency compounds has been recognized and the primary thrust of attempts to minimize this premature failure has been to increase the surface area of these materials relative to the remainder of the web in which they are placed. One of the most promising approaches has been the combination of individual particulate superabsorbents with meltblown microfiber. (The process for manufacture of a web containing meltblown microfibers is disclosed in U.S. Pat. No. 3,676,242.) This latter approach is described in British Application No. 8233488, has met with some success with regard to transporting and immobilizing fluid along the planar surface formed by the meltblown microfibrous web.

While this latter process more effectively utilizes superabsorbent material, in a situation where more absorbency is needed than can be provided on the surface of an absorbent web, the small capillaries of the meltblown microfiber coupled with the small capillaries of the extra absorbent material distributed throughout its planar surface, inhibit the downward, i.e., z direction transfer of fluid. This situation is particularly exacerbated when the fluid is viscous such as menses or blood.

SUMMARY OF THE INVENTION

According to this invention, a web containing a mixture of highly absorbent fibers and a fusible thermoplastic material is formed, slit in a predetermined pattern, e.g, by fibrillation, subjected to tension in both the machine and cross-direction. During tension, the fusible web material is fused to set the resultant apertured configuration of the web. The resulting product is a web having spaced apertures extending downward, i.e., in the z direction so that extra absorbent fibers and/or particles which may be present throughout the web are directly exposed to fluid contact. In other words, a substantially greater surface area is exposed to fluid directly rather than after the fluid has passed through other portions of the web. This increased exposed area provides for more efficient and complete utilization of the extra absorbent material while substantially minimizing the blocking phenomena associated with the smaller capillaries and heavily viscous fluid discussed previously. The web formed by this invention is particularly useful in a secretafacient device. Secretafacient is defined for purposes of this invention as a material which absorbs a variety of biological fluids with similar efficiency. As such the term is designed to cover absorbent materials which absorb both urinary secretions and menstrual exudate as well as fluid from surgical wounds.

While the process of fibrillation of webs has been described for example in U.S. Pat. Nos. 4,077,410 and 4,200,558 the fibrillation of a web of the type set forth in this invention for the structure and purposes disclosed have not been heretofore known.

DETAILED DESCRIPTION OF THE INVENTION AND DRAWINGS

The invention may more readily be understood by reference to the drawings in which FIG. 1 is a perspective view of the web with the short darkened fiber lines depicting a random dispersion of the extra absorbent material about the surface and throughout the web;

Figure 1:
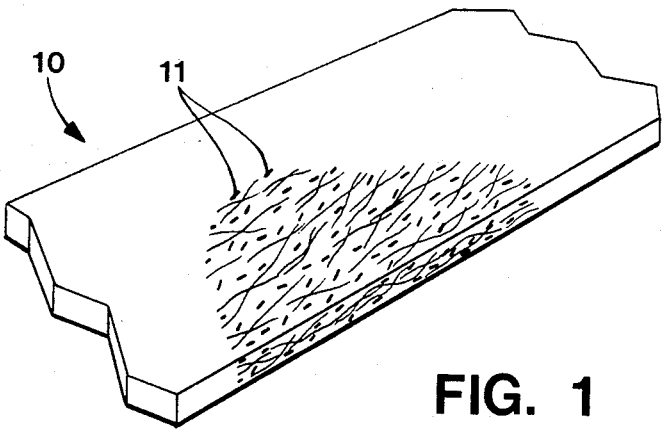

The web 10 as shown in FIG. 1 can, according to this invention be formed into a batt by any suitable conventional process such as airlaying and then linearly oriented by a card, air drawing or other conventional fiber orienting process dependent to some extent on the nature of the absorbent and thermoplastic material used. The web depicted at FIG. 1 shows the extra absorbent material as short fibers and these are generally preferred to powdered superabsorbent in the web forming operations utilizing carding and airlaying as opposed to a forming operation such as meltblowing which will be discussed subsequently.

Figure 2:
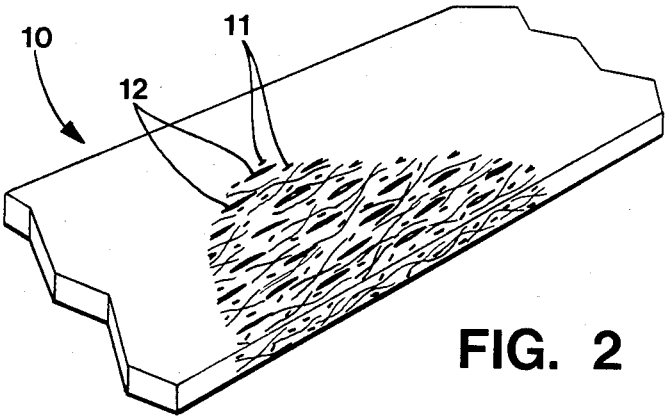
FIG. 2 is a perspective view of a web after fibrillation.
Figure 3:
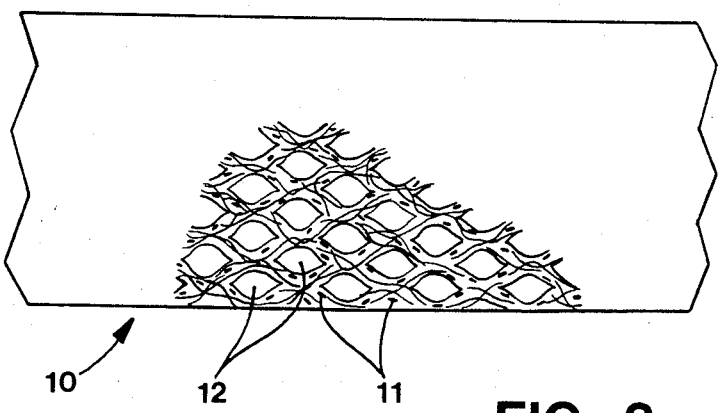
FIG. 3 is a plan view of a web after tensioning and setting.

After the web is formed and carded it is then subjected to a random cutting or slitting operation producing a web 10 such as depicted at FIG. 2 with slitting lines 12 formed in this instance by fibrillation by alternating small slits. The web is then tensioned both in the cross and machine direction and subjected to suitable conditions to fuse the fusible web component thereby providing a set configuration with the apertures formed by tensioning essentially permanently preserved. It is preferred to accomplish the tensioning and setting at the same time or essentially simultaneously by the application of heat to produce temperatures in the polymer equal to the glass transition temperature associated with the particular polymer. This will provide strechability and deformability as well as the relatively tacky surface necessary for the fusing to provide the basis for permanent set. The permanent set, of course, comes about after the temperature of the polymer is lowered below the glass transition temperature. As can be seen in FIG. 3, a web 10 produced by fibrillating tensioning and setting results in an open latticework structure with apertures 12 extending downward in the z direction throughout the web. As is depicted in FIG. 3, the superabsorbent fiber 11 is randomly dispersed with other fibers and are at the upper surface of the napkin and spaced at various positions throughout the depth of the various apertures.

While fibrillation and tensioning are a currently preferred method of producing the selected apertures according to this invention, it is contemplated that other operations to achieve apertures of control depth such as die cutting could also be used.

The controlling of depth of the apertures will vary in significance depending upon the particular application of the invention. If the web is to be relatively thick, apertures of decreasing size from the side adjacent bodily contact to the bottom of the web may be preferred so that fluid can be readily drawn into the bottom portion of such a web.

The web according to this invention must have some source of fibers. The fibers themselves may have some minimum absorbent capacity but can be primarily thermoplastic and hydrophobic. It is apparent that a web having only fibers of the highly absorbent material, conventional cellulosic material, and thermoplastic material can be made with the proportions of each varied to suit particular needs. It is not possible, however, to construct a web in which the primary structural component is extra absorbent fibers.

Further, it is not necessary to utilize thermoplastic hydrophobic fibers as the fusible component. Lower melting point polymers can be mixed during web formation in particulate form as is well known in the art to provide an adequate dispersion and essential uniformity in the apertured web after the apertures are formed.

While these extra absorbent fibers are preferred it is also possible to use extra absorbance in the form of particles which can be added as described in the preceding paragraph. In this instance, however, it is currently preferred that the structure be primarily derived from thermoplastic fibers.

Another variant contemplated by this invention is the use of extra absorbent particles which are added directly to the meltblowing process with slitting and tensioning easily performed while the polymer is still at the glass transition temperature inherent in meltblowing.

What is claimed is:

1. An absorbent web comprising linear oriented absorbent fibers in thermoplastic material said web including a purality of spaced apertures extending downward through the web surface thereby increasing the available surface area for fluid absorption.

2. The web according to claim 1 wherein said thermoplastic material is fibrous and provides a significant proportion of the structural strength of said web.

3. The web according to claim 1 wherein said thermoplastic material is in powder form.

4. A secretafacient device containing a web as set forth in claim 1 and a fluid impervious baffle.

* * * * *